US008251803B2

(12) United States Patent
Nelson

(10) Patent No.: US 8,251,803 B2
(45) Date of Patent: Aug. 28, 2012

(54) OVERLAPPING PROGRESSIVE JACKPOTS

(75) Inventor: Loren Nelson, Reno, NV (US)

(73) Assignee: Bally Gaming, Inc., Las Vegas, NV (US)

( * ) Notice: Subject to any disclaimer, the term of this patent is extended or adjusted under 35 U.S.C. 154(b) by 730 days.

(21) Appl. No.: 12/112,501

(22) Filed: Apr. 30, 2008

(65) Prior Publication Data

US 2009/0275398 A1 Nov. 5, 2009

(51) Int. Cl.
*A63F 9/24* (2006.01)

(52) U.S. Cl. ..... 463/27; 463/16; 463/25; 463/26

(58) Field of Classification Search ..... 463/16, 463/25–30; 273/138.1, 292
See application file for complete search history.

(56) References Cited

U.S. PATENT DOCUMENTS

| | | | | |
|---|---|---|---|---|
| 4,517,558 | A | 5/1985 | Davids | 340/700 |
| 4,517,654 | A | 5/1985 | Carmean | 364/521 |
| 4,621,814 | A | 11/1986 | Stepan et al. | 273/138 A |
| 4,721,307 | A | 1/1988 | Okada | 273/143 R |
| 4,814,589 | A | 3/1989 | Storch et al. | 235/375 |
| 4,837,728 | A | 6/1989 | Barrie et al. | 364/412 |
| 4,861,041 | A | 8/1989 | Jones et al. | 273/292 |
| 5,100,137 | A | 3/1992 | Fulton | 273/85 CP |
| 5,152,529 | A | 10/1992 | Okada | 273/143 R |
| 5,167,413 | A | 12/1992 | Fulton | 273/85 CP |
| 5,178,389 | A | 1/1993 | Bentley et al. | 273/138 A |
| 5,242,163 | A | 9/1993 | Fulton | 273/85 CP |
| 5,248,142 | A | 9/1993 | Breeding | 273/138 R |
| 5,251,897 | A | 10/1993 | Fulton | 273/85 CP |
| 5,275,400 | A | 1/1994 | Weingardt et al. | 273/85 CP |
| 5,283,422 | A | 2/1994 | Storch et al. | 235/375 |
| 5,321,241 | A | 6/1994 | Craine | 235/380 |
| 5,332,219 | A | 7/1994 | Marnell, II et al. | 273/138 A |
| 5,344,144 | A | 9/1994 | Canon | 273/138 A |
| 5,364,104 | A | 11/1994 | Jones et al. | 273/292 |
| 5,389,945 | A | 2/1995 | Sheridon | 345/85 |
| 5,393,067 | A | 2/1995 | Paulsen et al. | 273/292 |
| 5,411,257 | A | 5/1995 | Fulton | 273/85 CP |
| 5,417,430 | A | 5/1995 | Breeding | 273/292 |
| 5,431,408 | A | 7/1995 | Adams | 273/306 |
| 5,437,451 | A | 8/1995 | Fulton | 273/138 A |

(Continued)

FOREIGN PATENT DOCUMENTS

EP 0 790 848 B1 8/1997

(Continued)

OTHER PUBLICATIONS

Bally Technologies, Inc., iVIEW, http://ballytech.com/systems/product.cfm?id=9, download date Nov. 6, 2007, 2 pages.

(Continued)

*Primary Examiner* — Masud Ahmed
(74) *Attorney, Agent, or Firm* — Seed IP Law Group PLLC

(57) ABSTRACT

A gaming device accepts a wager. The wager is logically associated with a first progressive jackpot, the first progressive jackpot associated with a first set of participating gaming devices. The wager is also logically associated with a second progressive jackpot different than the first progressive jackpot, the second progressive jackpot associated with a second set of participating gaming devices, the second set of participating gaming devices comprising more gaming devices than the first set of participating gaming devices.

18 Claims, 5 Drawing Sheets

U.S. PATENT DOCUMENTS

| | | | | |
|---|---|---|---|---|
| 5,462,277 | A | 10/1995 | Takemoto | 273/121 B |
| 5,470,079 | A | 11/1995 | LeStrange et al. | 273/138 A |
| 5,472,194 | A | 12/1995 | Breeding et al. | 273/138 A |
| 5,513,851 | A | 5/1996 | Harris | 273/274 |
| 5,544,892 | A | 8/1996 | Breeding | 273/292 |
| 5,544,893 | A | 8/1996 | Jones et al. | 273/309 |
| 5,559,312 | A | 9/1996 | Lucero | 235/380 |
| 5,559,950 | A | 9/1996 | Cannon | 395/162 |
| 5,562,284 | A | 10/1996 | Stevens | 273/139 |
| 5,570,885 | A | 11/1996 | Ornstein | 463/27 |
| 5,605,334 | A | 2/1997 | McCrea, Jr. | 273/309 |
| 5,613,912 | A | 3/1997 | Slater | 463/25 |
| 5,630,753 | A | 5/1997 | Fuchs | 463/9 |
| 5,636,842 | A | 6/1997 | Cabot et al. | 273/292 |
| 5,636,843 | A | 6/1997 | Roberts | 273/292 |
| 5,645,486 | A | 7/1997 | Nagao et al. | 463/27 |
| 5,653,635 | A | 8/1997 | Breeding | 463/11 |
| 5,655,961 | A | 8/1997 | Acres et al. | 463/27 |
| 5,685,774 | A | 11/1997 | Webb | 463/13 |
| 5,707,287 | A | 1/1998 | McCrea, Jr. | 463/27 |
| 5,711,525 | A | 1/1998 | Breeding | 273/292 |
| 5,735,525 | A | 4/1998 | McCrea, Jr. | 273/309 |
| 5,743,800 | A | 4/1998 | Huard et al. | 463/26 |
| 5,745,110 | A | 4/1998 | Ertemalp | 345/340 |
| 5,752,881 | A | 5/1998 | Inoue | 463/20 |
| 5,758,875 | A | 6/1998 | Giacalone, Jr. | 273/143 R |
| 5,759,103 | A | 6/1998 | Freels et al. | 463/42 |
| 5,766,076 | A | 6/1998 | Pease et al. | 463/27 |
| 5,770,914 | A | 6/1998 | Pease et al. | 310/339 |
| 5,788,574 | A | 8/1998 | Ornstein et al. | 463/25 |
| 5,794,964 | A | 8/1998 | Jones et al. | 273/309 |
| 5,795,225 | A | 8/1998 | Jones et al. | 463/13 |
| 5,796,389 | A | 8/1998 | Bertram et al. | 345/173 |
| 5,803,809 | A | 9/1998 | Yoseloff | 463/13 |
| 5,816,918 | A | 10/1998 | Kelly et al. | 463/16 |
| 5,823,534 | A | 10/1998 | Banyai | 273/269 |
| 5,823,879 | A | 10/1998 | Goldberg et al. | 463/42 |
| 5,830,067 | A | 11/1998 | Graves et al. | 463/40 |
| 5,830,068 | A | 11/1998 | Brenner et al. | 463/42 |
| 5,833,536 | A | 11/1998 | Davids et al. | 463/11 |
| 5,836,586 | A | 11/1998 | Marks et al. | 273/292 |
| 5,839,730 | A | 11/1998 | Pike | 273/292 |
| 5,842,921 | A | 12/1998 | Mindes et al. | 463/16 |
| 5,851,011 | A | 12/1998 | Lott | 273/292 |
| 5,851,148 | A | 12/1998 | Brune et al. | 463/25 |
| 5,855,515 | A | 1/1999 | Pease et al. | 463/27 |
| 5,871,213 | A | 2/1999 | Chadband et al. | 273/292 |
| 5,885,158 | A * | 3/1999 | Torango et al. | 463/27 |
| 5,890,963 | A | 4/1999 | Yen | 463/42 |
| 5,911,418 | A | 6/1999 | Adams | 273/274 |
| 5,911,419 | A | 6/1999 | Delaney et al. | 273/292 |
| 5,911,626 | A | 6/1999 | McCrea, Jr. | 463/27 |
| 5,934,676 | A | 8/1999 | Rubin | 273/309 |
| 5,934,999 | A | 8/1999 | Valdez | 463/17 |
| 5,941,769 | A | 8/1999 | Order | 463/12 |
| 5,951,397 | A | 9/1999 | Dickinson | 463/36 |
| 5,967,894 | A | 10/1999 | Kinoshita et al. | 463/13 |
| 5,999,808 | A | 12/1999 | LaDue | 455/412 |
| 6,003,867 | A | 12/1999 | Rodesch et al. | 273/143 R |
| 6,004,205 | A | 12/1999 | Lauretta et al. | 463/11 |
| 6,004,208 | A | 12/1999 | Takemoto et al. | 463/20 |
| 6,019,374 | A | 2/2000 | Breeding | 273/292 |
| 6,027,115 | A | 2/2000 | Griswold et al. | 273/143 R |
| 6,032,955 | A | 3/2000 | Luciano et al. | 273/138.1 |
| 6,045,130 | A | 4/2000 | Jones et al. | 273/292 |
| 6,056,641 | A | 5/2000 | Webb | 463/13 |
| 6,059,289 | A | 5/2000 | Vancura | 273/143 R |
| 6,062,565 | A | 5/2000 | Chadband et al. | 273/292 |
| 6,062,981 | A | 5/2000 | Luciano, Jr. | 463/26 |
| 6,068,552 | A | 5/2000 | Walker et al. | 463/21 |
| 6,068,553 | A | 5/2000 | Parker | 463/27 |
| 6,070,878 | A | 6/2000 | Jones et al. | 273/309 |
| 6,089,978 | A | 7/2000 | Adams | 463/20 |
| 6,089,980 | A | 7/2000 | Gauselmann | 463/27 |
| 6,093,103 | A | 7/2000 | McCrea, Jr. | 463/27 |
| 6,099,407 | A | 8/2000 | Parker, Jr. et al. | 463/19 |
| 6,102,394 | A | 8/2000 | Wurz et al. | 273/138.2 |
| 6,102,799 | A | 8/2000 | Stupak | 463/27 |
| 6,105,964 | A | 8/2000 | Maahs | 273/292 |
| 6,110,043 | A | 8/2000 | Olsen | 463/27 |
| 6,117,012 | A | 9/2000 | McCrea, Jr. | 463/27 |
| 6,120,377 | A | 9/2000 | McGinnis, Sr. et al. | 463/20 |
| 6,123,333 | A | 9/2000 | McGinnis, Sr. et al. | 273/146 |
| 6,126,542 | A | 10/2000 | Fier | 463/16 |
| 6,135,453 | A | 10/2000 | Srichayaporn | 273/292 |
| 6,135,884 | A | 10/2000 | Hedrick et al. | 463/20 |
| 6,142,876 | A | 11/2000 | Cumbers | 463/25 |
| 6,146,273 | A | 11/2000 | Olsen | 463/27 |
| 6,152,822 | A | 11/2000 | Herbert | 463/22 |
| 6,155,925 | A | 12/2000 | Giobbi et al. | 463/20 |
| 6,168,523 | B1 | 1/2001 | Piechowiak et al. | 463/26 |
| 6,179,711 | B1 | 1/2001 | Yoseloff | 463/25 |
| 6,186,894 | B1 | 2/2001 | Mayeroff | 463/20 |
| 6,186,895 | B1 | 2/2001 | Oliver | 463/25 |
| 6,201,532 | B1 | 3/2001 | Tode et al. | 345/156 |
| 6,203,430 | B1 | 3/2001 | Walker et al. | 463/20 |
| 6,206,780 | B1 | 3/2001 | Awada | 463/13 |
| 6,210,275 | B1 | 4/2001 | Olsen | 463/16 |
| 6,210,277 | B1 | 4/2001 | Stefan | 463/27 |
| 6,210,279 | B1 | 4/2001 | Dickinson | 463/37 |
| 6,213,875 | B1 | 4/2001 | Suzuki | 463/20 |
| 6,213,877 | B1 | 4/2001 | Walker et al. | 463/26 |
| 6,217,447 | B1 | 4/2001 | Lofink et al. | 463/12 |
| 6,224,483 | B1 | 5/2001 | Mayeroff | 463/20 |
| 6,224,484 | B1 | 5/2001 | Okuda et al. | 463/27 |
| 6,227,969 | B1 | 5/2001 | Yoseloff | 463/13 |
| 6,227,970 | B1 | 5/2001 | Shimizu et al. | 463/20 |
| 6,234,898 | B1 | 5/2001 | Belamant et al. | 463/25 |
| 6,244,958 | B1 | 6/2001 | Acres | 463/26 |
| 6,254,484 | B1 | 7/2001 | McCrea, Jr. | 463/27 |
| 6,273,424 | B1 | 8/2001 | Breeding | 273/292 |
| 6,287,202 | B1 | 9/2001 | Pascal et al. | 463/42 |
| 6,290,603 | B1 | 9/2001 | Luciano, Jr. | 463/25 |
| 6,293,864 | B1 | 9/2001 | Romero | 463/12 |
| 6,302,790 | B1 | 10/2001 | Brossard | 463/20 |
| 6,302,793 | B1 | 10/2001 | Fertitta, III et al. | 463/25 |
| 6,309,300 | B1 | 10/2001 | Glavich | 463/26 |
| 6,312,332 | B1 | 11/2001 | Walker et al. | 463/23 |
| 6,312,334 | B1 | 11/2001 | Yoseloff | 463/25 |
| 6,315,664 | B1 | 11/2001 | Baerlocher et al. | 463/21 |
| 6,315,666 | B1 | 11/2001 | Mastera et al. | 463/31 |
| 6,319,124 | B1 | 11/2001 | Baerlocher et al. | 463/20 |
| 6,322,078 | B1 | 11/2001 | Adams | 273/292 |
| 6,328,649 | B1 | 12/2001 | Randall et al. | 463/20 |
| 6,334,614 | B1 | 1/2002 | Breeding | 273/292 |
| 6,334,814 | B1 | 1/2002 | Adams | 463/20 |
| 6,336,863 | B1 | 1/2002 | Baerlocher et al. | 463/27 |
| 6,346,043 | B1 | 2/2002 | Colin et al. | 463/17 |
| 6,346,044 | B1 | 2/2002 | McCrea, Jr. | 463/27 |
| 6,350,199 | B1 | 2/2002 | Williams et al. | 463/16 |
| 6,361,044 | B1 | 3/2002 | Block et al. | 273/149 R |
| 6,364,767 | B1 | 4/2002 | Brossard et al. | 463/20 |
| 6,368,216 | B1 | 4/2002 | Hedrick et al. | 463/20 |
| 6,375,187 | B1 | 4/2002 | Baerlocher | 273/143 R |
| 6,375,569 | B1 | 4/2002 | Acres | 463/31 |
| 6,383,076 | B1 | 5/2002 | Tiedeken | 463/40 |
| 6,386,974 | B1 | 5/2002 | Adams | 463/16 |
| 6,394,902 | B1 | 5/2002 | Glavich et al. | 463/20 |
| 6,398,220 | B1 | 6/2002 | Inoue | 273/142 R |
| 6,406,023 | B1 | 6/2002 | Rowe | 273/292 |
| 6,406,369 | B1 | 6/2002 | Baerlocher et al. | 463/20 |
| 6,413,161 | B1 | 7/2002 | Baerlocher et al. | 463/20 |
| 6,413,162 | B1 | 7/2002 | Baerlocher et al. | 463/20 |
| 6,416,408 | B2 | 7/2002 | Tracy et al. | 463/16 |
| 6,419,583 | B1 | 7/2002 | Crumby et al. | 463/42 |
| 6,425,824 | B1 | 7/2002 | Baerlocher et al. | 463/16 |
| 6,439,995 | B1 | 8/2002 | Hughs-Baird et al. | 463/20 |
| 6,443,452 | B1 | 9/2002 | Brune | 273/143 R |
| 6,454,266 | B1 | 9/2002 | Breeding et al. | 273/292 |
| 6,454,649 | B1 | 9/2002 | Mattice et al. | 463/17 |
| 6,460,848 | B1 | 10/2002 | Soltys et al. | 273/149 R |
| 6,461,241 | B1 | 10/2002 | Webb et al. | 463/20 |
| 6,464,582 | B1 | 10/2002 | Baerlocher et al. | 463/20 |
| 6,464,584 | B2 | 10/2002 | Oliver | 463/25 |
| 6,468,156 | B1 | 10/2002 | Hughs-Baird et al. | 463/25 |
| 6,471,208 | B2 | 10/2002 | Yoseloff et al. | 273/143 R |
| 6,471,591 | B1 | 10/2002 | Crumby | 463/26 |

6,476,798 B1 11/2002 Bertram et al. ..... 345/174
6,494,454 B2 12/2002 Adams ..... 273/292
6,494,785 B1 12/2002 Gerrard et al. ..... 463/20
6,497,408 B1 12/2002 Walker et al. ..... 273/138.1
6,506,118 B1 1/2003 Baerlocher et al. ..... 463/25
6,508,709 B1 1/2003 Karmarkar ..... 463/42
6,508,710 B1 1/2003 Paravia et al. ..... 463/42
6,511,375 B1 1/2003 Kaminkow ..... 463/20
6,514,141 B1 2/2003 Kaminkow et al. ..... 463/25
6,517,435 B2 2/2003 Soltys et al. ..... 463/25
6,517,436 B2 2/2003 Soltys et al. ..... 463/29
6,517,437 B1 2/2003 Wells et al. ..... 463/30
6,520,856 B1 2/2003 Walker et al. ..... 463/21
6,520,857 B2 2/2003 Soltys et al. ..... 463/29
6,527,271 B2 3/2003 Soltys et al. ..... 273/148 R
6,527,638 B1 3/2003 Walker et al. ..... 463/25
6,530,836 B2 3/2003 Soltys et al. ..... 463/29
6,530,837 B2 3/2003 Soltys et al. ..... 463/29
6,530,842 B1 3/2003 Wells et al. ..... 463/46
6,533,276 B2 3/2003 Soltys et al. ..... 273/148 R
6,533,662 B2 3/2003 Soltys et al. ..... 463/25
6,554,703 B1 4/2003 Bussick et al. ..... 463/20
6,558,254 B2 5/2003 Baelocher et al. ..... 463/20
6,561,900 B1 5/2003 Baerlocher et al. ..... 463/20
6,561,908 B1 5/2003 Hoke ..... 463/35
6,565,433 B1 5/2003 Baerlocher et al. ..... 463/20
6,565,436 B1 5/2003 Baerlocher ..... 463/26
6,569,015 B1 5/2003 Baerlocher et al. ..... 463/16
6,572,204 B1 6/2003 Hedrick et al. ..... 312/223.1
6,572,472 B1 6/2003 Glavich ..... 463/16
6,572,473 B1 6/2003 Baerlocher ..... 463/20
6,575,541 B1 6/2003 Hedrick et al. ..... 312/223.1
6,575,829 B2 6/2003 Coleman et al. ..... 463/20
6,575,830 B2 6/2003 Baerlocher et al. ..... 463/20
6,579,180 B2 6/2003 Soltys et al. ..... 463/25
6,579,181 B2 6/2003 Soltys et al. ..... 463/25
6,582,306 B1 6/2003 Kaminkow ..... 463/20
6,582,307 B2 6/2003 Webb ..... 463/22
6,585,588 B2 7/2003 Hartl ..... 463/16
6,585,591 B1 7/2003 Baerlocher et al. ..... 463/25
6,585,592 B1 7/2003 Crumby ..... 463/26
6,592,458 B1 7/2003 Ho ..... 463/17
6,595,854 B2 7/2003 Hughs-Baird et al. ..... 463/20
6,595,857 B2 7/2003 Soltys et al. ..... 463/29
6,599,185 B1 7/2003 Kaminkow et al. ..... 463/16
6,599,192 B1 7/2003 Baerlocher et al. ..... 463/25
6,599,193 B2 7/2003 Baerlocher et al. ..... 463/27
6,602,135 B1 8/2003 Gerrard ..... 463/16
6,602,136 B1 8/2003 Baerlocher et al. ..... 463/16
6,602,137 B2 8/2003 Kaminkow et al. ..... 463/16
6,605,000 B2 8/2003 Adams ..... 463/20
6,605,002 B2 8/2003 Baerlocher ..... 463/25
6,607,438 B2 8/2003 Baerlocher et al. ..... 463/16
6,607,441 B1 8/2003 Acres ..... 463/25
6,609,974 B2 8/2003 Mead et al. ..... 463/25
6,620,046 B2 9/2003 Rowe ..... 463/25
6,620,047 B1 9/2003 Alcorn et al. ..... 463/37
6,623,357 B2 9/2003 Chowdhury ..... 463/25
6,628,939 B2 9/2003 Paulsen ..... 455/414
6,629,591 B1 10/2003 Griswold et al. ..... 194/205
6,632,139 B1 10/2003 Baerlocher ..... 463/16
6,634,943 B1 10/2003 Baerlocher ..... 463/25
6,634,945 B2 10/2003 Glavich et al. ..... 463/25
6,638,164 B2 10/2003 Randall et al. ..... 463/20
6,645,073 B2 11/2003 Lemay et al. ..... 463/20
6,645,078 B1 11/2003 Mattice ..... 463/42
6,648,753 B1 11/2003 Tracy et al. ..... 463/16
6,648,754 B2 11/2003 Baerlocher et al. ..... 463/17
6,651,985 B2 11/2003 Sines et al. ..... 273/309
6,652,378 B2 11/2003 Cannon et al. ..... 463/20
6,656,040 B1 12/2003 Brosnan et al. ..... 463/16
6,656,041 B1 12/2003 Kaminkow et al. ..... 463/16
6,656,048 B2 12/2003 Olsen ..... 463/25
6,659,461 B2 12/2003 Yoseloff et al. ..... 273/274
6,659,864 B2 12/2003 McGahn et al. ..... 463/16
6,663,488 B1 12/2003 Adams ..... 463/17
6,663,489 B2 12/2003 Baerlocher ..... 463/20
6,663,490 B2 12/2003 Soltys et al. ..... 463/25
6,669,559 B1 12/2003 Baerlocher et al. ..... 463/16
6,672,960 B1 1/2004 B-Jensen ..... 463/20
6,685,564 B2 2/2004 Oliver ..... 463/25
6,688,975 B2 2/2004 Baerlocher et al. ..... 463/16
6,688,977 B1 2/2004 Baerlocher et al. ..... 463/25
6,688,979 B2 2/2004 Soltys et al. ..... 463/25
6,692,354 B2 2/2004 Tracy et al. ..... 463/16
6,692,355 B2 2/2004 Baerlocher et al. ..... 463/16
6,692,356 B2 2/2004 Baerlocher et al. ..... 463/20
6,695,696 B1 2/2004 Kaminkow ..... 463/16
6,695,699 B2 2/2004 Beaulieu ..... 463/25
6,695,703 B1 2/2004 McGahn ..... 463/46
6,702,291 B2 3/2004 Grebler et al. ..... 273/292
6,702,409 B2 3/2004 Hedrick et al. ..... 312/223.1
6,702,667 B2 3/2004 Mattice et al. ..... 463/16
6,702,672 B1 3/2004 Angell et al. ..... 463/25
6,712,693 B1 3/2004 Hettinger ..... 463/20
6,712,694 B1 3/2004 Nordman ..... 463/20
6,712,695 B2 3/2004 Mothwurf et al. ..... 463/25
6,712,696 B2 3/2004 Soltys et al. ..... 463/25
6,712,698 B2 3/2004 Paulsen et al. ..... 463/30
6,719,632 B2 4/2004 Palmer et al. ..... 463/25
6,722,974 B2 4/2004 Sines et al. ..... 463/12
6,722,976 B2 4/2004 Adams ..... 463/16
6,722,981 B2 4/2004 Kaminkow et al. ..... 463/25
6,722,982 B2 4/2004 Kaminkow et al. ..... 463/25
6,722,983 B2 4/2004 Kaminkow et al. ..... 463/26
6,726,563 B1 4/2004 Baerlocher et al. ..... 463/25
6,726,565 B2 4/2004 Hughs-Baird ..... 463/25
6,731,313 B1 5/2004 Kaminkow ..... 345/839
6,733,386 B2 5/2004 Cuddy et al. ..... 463/17
6,733,389 B2 5/2004 Webb et al. ..... 463/20
6,734,843 B2 5/2004 Bertram et al. ..... 345/173
6,743,102 B1 6/2004 Fiechter et al. ..... 463/42
6,746,328 B2 6/2004 Cannon et al. ..... 463/17
6,749,504 B2 6/2004 Hughs-Baird ..... 463/25
6,755,741 B1 6/2004 Rafaeli ..... 463/25
6,758,747 B2 7/2004 Baerlocher ..... 463/16
6,758,750 B2 7/2004 Baerlocher et al. ..... 463/25
6,758,751 B2 7/2004 Soltys et al. ..... 463/29
6,761,632 B2 7/2004 Bansemer et al. ..... 463/16
6,769,983 B2 8/2004 Slomiany ..... 463/16
6,769,985 B1 8/2004 Laakso et al. ..... 463/25
6,789,801 B2 9/2004 Snow ..... 273/292
6,800,029 B2 10/2004 Rowe et al. ..... 463/25
6,808,173 B2 10/2004 Snow ..... 273/292
6,811,486 B1 11/2004 Luciano, Jr. ..... 463/24
6,811,488 B2 11/2004 Paravia et al. ..... 463/42
6,817,948 B2 11/2004 Pascal et al. ..... 463/42
6,837,789 B2 1/2005 Garahi et al. ..... 463/29
6,874,786 B2 4/2005 Bruno et al. ..... 273/306
6,887,157 B2 5/2005 LeMay et al. ..... 463/32
6,902,481 B2 6/2005 Breckner et al. ..... 463/30
6,923,446 B2 8/2005 Snow ..... 273/292
6,938,900 B2 9/2005 Snow ..... 273/292
6,955,599 B2 10/2005 Bourbour et al. ..... 463/13
6,960,134 B2 11/2005 Hartl et al. ..... 463/20
6,986,514 B2 1/2006 Snow ..... 273/292
6,991,544 B2 1/2006 Soltys et al. ..... 463/42
7,000,921 B2 2/2006 Schultz ..... 273/292
7,025,674 B2 4/2006 Adams et al. ..... 463/1
7,029,009 B2 4/2006 Grauzer et al. ..... 273/149 P
7,037,195 B2 5/2006 Schneider et al. ..... 463/25
7,048,630 B2 5/2006 Berg et al. ..... 463/30
7,050,056 B2 5/2006 Meyringer ..... 345/440
7,063,615 B2 6/2006 Alcorn et al. ..... 463/1
7,086,947 B2 8/2006 Walker et al. ..... 463/25
7,147,558 B2 12/2006 Giobbi ..... 463/25
7,213,812 B2 5/2007 Schubert et al. ..... 273/149 R
7,264,241 B2 9/2007 Schubert et al. ..... 273/149 R
7,275,988 B2 10/2007 Aida et al. ..... 463/20
7,291,068 B2 11/2007 Bryant et al. ..... 463/25
7,309,065 B2 12/2007 Yoseloff et al. ..... 273/292
7,311,598 B2 12/2007 Kaminkow et al. ..... 463/16
7,311,605 B2 12/2007 Moser ..... 463/25
7,330,822 B1 2/2008 Robson et al. ..... 705/9
7,331,579 B2 2/2008 Snow ..... 273/292
7,331,859 B2 2/2008 Hornik et al. ..... 463/16
7,349,920 B1 3/2008 Feinberg et al. ..... 707/102
7,351,145 B1 4/2008 Ornstein et al. ..... 463/25

| | | | | |
|---|---|---|---|---|
| 7,356,770 | B1 | 4/2008 | Jackson | 715/736 |
| 7,364,510 | B2 | 4/2008 | Walker et al. | 463/42 |
| 7,367,885 | B2 | 5/2008 | Escalera et al. | 463/32 |
| 7,370,282 | B2 | 5/2008 | Cary | 715/772 |
| 7,384,339 | B2 | 6/2008 | LeMay et al. | 463/30 |
| 7,404,763 | B2 | 7/2008 | Malone et al. | 463/13 |
| 7,407,438 | B2 | 8/2008 | Schubert et al. | 463/22 |
| 7,422,522 | B2 | 9/2008 | Fujimoto et al. | 463/16 |
| 7,427,234 | B2 | 9/2008 | Soltys et al. | 463/16 |
| 7,427,236 | B2 | 9/2008 | Kaminkow et al. | 463/26 |
| 7,434,805 | B2 | 10/2008 | Grauzer et al. | 273/149 R |
| 7,465,231 | B2 | 12/2008 | Lewin et al. | 463/37 |
| 7,481,430 | B1 | 1/2009 | Jackson et al. | 273/138.1 |
| 7,483,394 | B2 | 1/2009 | Chang et al. | 370/254 |
| 7,494,413 | B2 | 2/2009 | Singer et al. | 463/20 |
| 7,540,806 | B2 | 6/2009 | Tastad | 463/46 |
| 7,566,274 | B2 | 7/2009 | Johnson et al. | 463/42 |
| 7,575,234 | B2 | 8/2009 | Soltys et al. | 273/149 R |
| 7,585,217 | B2 | 9/2009 | Lutnick et al. | 463/16 |
| 7,591,724 | B2 * | 9/2009 | Baerlocher | 463/20 |
| 7,618,317 | B2 | 11/2009 | Jackson | 463/24 |
| 7,674,179 | B2 | 3/2010 | Baerlocher et al. | 463/27 |
| 7,736,221 | B2 | 6/2010 | Black et al. | 463/13 |
| 7,736,223 | B2 | 6/2010 | Pace | 463/19 |
| 7,775,868 | B2 | 8/2010 | Toyoda | 463/12 |
| 7,780,526 | B2 | 8/2010 | Nguyen et al. | 463/29 |
| 7,850,528 | B2 | 12/2010 | Wells | 463/42 |
| 7,854,654 | B2 | 12/2010 | Baerlocher et al. | 463/27 |
| 7,874,920 | B2 | 1/2011 | Hornik et al. | 463/42 |
| 7,901,294 | B2 | 3/2011 | Walker et al. | 463/42 |
| 2002/0063389 | A1 | 5/2002 | Breeding et al. | 273/292 |
| 2002/0084587 | A1 | 7/2002 | Bennett et al. | 273/309 |
| 2002/0086725 | A1 | 7/2002 | Fasbender et al. | 463/11 |
| 2002/0113371 | A1 | 8/2002 | Snow | 273/292 |
| 2002/0115487 | A1 | 8/2002 | Wells | 463/42 |
| 2002/0163125 | A1 | 11/2002 | Grauzer et al. | 273/149 R |
| 2002/0187825 | A1 | 12/2002 | Tracy et al. | 463/17 |
| 2002/0198044 | A1 | 12/2002 | Walker et al. | 463/25 |
| 2003/0004871 | A1 | 1/2003 | Rowe | 705/39 |
| 2003/0027625 | A1 * | 2/2003 | Rowe | 463/20 |
| 2003/0032474 | A1 | 2/2003 | Kaminkow | 463/25 |
| 2003/0036425 | A1 | 2/2003 | Kaminkow et al. | 463/25 |
| 2003/0042679 | A1 | 3/2003 | Snow | 273/292 |
| 2003/0075869 | A1 | 4/2003 | Breeding et al. | 273/292 |
| 2003/0078789 | A1 | 4/2003 | Oren | 705/1 |
| 2003/0186739 | A1 | 10/2003 | Paulsen et al. | 463/25 |
| 2004/0043815 | A1 | 3/2004 | Kaminkow | 463/25 |
| 2004/0087375 | A1 | 5/2004 | Gelinotte | 463/47 |
| 2004/0090003 | A1 | 5/2004 | Snow | 273/274 |
| 2004/0102244 | A1 | 5/2004 | Kryuchkov et al. | 463/32 |
| 2004/0127291 | A1 | 7/2004 | George et al. | 463/42 |
| 2004/0133485 | A1 | 7/2004 | Schoomaker et al. | 705/30 |
| 2004/0142743 | A1 | 7/2004 | Oliver | 463/25 |
| 2004/0166918 | A1 | 8/2004 | Walker et al. | 463/16 |
| 2004/0254010 | A1 | 12/2004 | Fine | 463/25 |
| 2004/0254012 | A1 * | 12/2004 | D'Amico et al. | 463/26 |
| 2004/0259630 | A1 | 12/2004 | Huard et al. | 463/25 |
| 2005/0043094 | A1 | 2/2005 | Nguyen et al. | 463/42 |
| 2005/0054438 | A1 | 3/2005 | Rothschild et al. | 463/29 |
| 2005/0055113 | A1 | 3/2005 | Gauselmann | 700/91 |
| 2005/0070358 | A1 | 3/2005 | Angell et al. | 463/39 |
| 2005/0098951 | A1 | 5/2005 | Groves | 273/292 |
| 2005/0119052 | A1 | 6/2005 | Russell et al. | 463/42 |
| 2005/0124411 | A1 | 6/2005 | Schneider et al. | 463/29 |
| 2005/0143166 | A1 | 6/2005 | Walker et al. | 463/25 |
| 2005/0153778 | A1 | 7/2005 | Nelson et al. | 463/42 |
| 2005/0181856 | A1 | 8/2005 | Cannon et al. | 463/16 |
| 2005/0181864 | A1 | 8/2005 | Britt et al. | 463/25 |
| 2005/0215311 | A1 | 9/2005 | Hornik et al. | 463/20 |
| 2005/0221882 | A1 | 10/2005 | Nguyen et al. | 463/16 |
| 2005/0222891 | A1 | 10/2005 | Chan et al. | 705/9 |
| 2005/0239542 | A1 | 10/2005 | Olsen | 463/27 |
| 2005/0255911 | A1 | 11/2005 | Nguyen et al. | 463/25 |
| 2005/0266919 | A1 | 12/2005 | Rowe et al. | 463/25 |
| 2005/0282626 | A1 | 12/2005 | Manfredi et al. | 463/25 |
| 2006/0009282 | A1 | 1/2006 | George et al. | 463/29 |
| 2006/0026499 | A1 | 2/2006 | Weddle | 715/503 |
| 2006/0046849 | A1 | 3/2006 | Kovacs | 463/39 |
| 2006/0058100 | A1 | 3/2006 | Pacey et al. | 463/31 |
| 2006/0079317 | A1 | 4/2006 | Flemming et al. | 463/25 |
| 2006/0121970 | A1 | 6/2006 | Khal | 463/16 |
| 2006/0183541 | A1 | 8/2006 | Okada et al. | 463/29 |
| 2006/0205484 | A1 | 9/2006 | Nicastro | 463/25 |
| 2006/0247013 | A1 | 11/2006 | Walker et al. | 463/20 |
| 2006/0281529 | A1 | 12/2006 | Seelig et al. | 463/20 |
| 2006/0287077 | A1 * | 12/2006 | Grav et al. | 463/27 |
| 2007/0015583 | A1 | 1/2007 | Tran | 463/40 |
| 2007/0060307 | A1 | 3/2007 | Mathis et al. | 463/25 |
| 2007/0060365 | A1 | 3/2007 | Tien et al. | 463/42 |
| 2007/0077990 | A1 | 4/2007 | Cuddy et al. | 463/25 |
| 2007/0082737 | A1 | 4/2007 | Morrow et al. | 463/42 |
| 2007/0093298 | A1 | 4/2007 | Brunet | 463/42 |
| 2007/0111775 | A1 | 5/2007 | Yoseloff | 463/16 |
| 2007/0117608 | A1 | 5/2007 | Roper et al. | 463/16 |
| 2007/0167235 | A1 | 7/2007 | Naicker | 463/42 |
| 2007/0191102 | A1 | 8/2007 | Coliz et al. | 463/42 |
| 2007/0207850 | A1 | 9/2007 | Darrah et al. | 463/20 |
| 2007/0208816 | A1 | 9/2007 | Baldwin et al. | 709/206 |
| 2007/0235521 | A1 | 10/2007 | Mateen et al. | 235/379 |
| 2007/0243925 | A1 | 10/2007 | LeMay et al. | 463/20 |
| 2007/0243927 | A1 | 10/2007 | Soltys | 463/25 |
| 2007/0243935 | A1 | 10/2007 | Huizinga | 463/42 |
| 2007/0259709 | A1 | 11/2007 | Kelly et al. | 463/20 |
| 2007/0259711 | A1 | 11/2007 | Thomas | 463/22 |
| 2007/0287535 | A1 | 12/2007 | Soltys | 463/29 |
| 2007/0293303 | A1 | 12/2007 | Shayesteh | 463/25 |
| 2007/0298868 | A1 | 12/2007 | Soltys | 463/25 |
| 2007/0298874 | A1 * | 12/2007 | Baerlocher et al. | 463/27 |
| 2008/0009344 | A1 | 1/2008 | Graham et al. | 463/25 |
| 2008/0026832 | A1 | 1/2008 | Stevens et al. | 463/26 |
| 2008/0026848 | A1 | 1/2008 | Byng | 463/42 |
| 2008/0045341 | A1 | 2/2008 | Englman | 463/42 |
| 2008/0045344 | A1 | 2/2008 | Schlottmann et al. | 463/25 |
| 2008/0090651 | A1 * | 4/2008 | Baerlocher | 463/27 |
| 2008/0113704 | A1 | 5/2008 | Jackson | 463/13 |
| 2008/0113764 | A1 | 5/2008 | Soltys | 463/22 |
| 2008/0113773 | A1 | 5/2008 | Johnson et al. | 463/25 |
| 2008/0113781 | A1 | 5/2008 | Soltys et al. | 463/28 |
| 2008/0119284 | A1 | 5/2008 | Luciano, Jr. et al. | 463/42 |
| 2008/0214277 | A1 | 9/2008 | Kishi | 463/20 |
| 2008/0287185 | A1 * | 11/2008 | Yoseloff et al. | 463/27 |
| 2009/0005176 | A1 | 1/2009 | Morrow et al. | 463/43 |
| 2009/0011833 | A1 | 1/2009 | Seelig et al. | 463/42 |
| 2009/0069076 | A1 | 3/2009 | Silvestro | 463/25 |
| 2009/0115133 | A1 | 5/2009 | Kelly et al. | 273/274 |
| 2009/0117994 | A1 | 5/2009 | Kelly et al. | 463/25 |
| 2009/0118001 | A1 | 5/2009 | Kelly et al. | 463/29 |
| 2009/0118005 | A1 | 5/2009 | Kelly et al. | 463/31 |
| 2009/0176556 | A1 | 7/2009 | Gagner et al. | 463/25 |
| 2009/0176580 | A1 | 7/2009 | Herrmann et al. | 463/43 |
| 2009/0253483 | A1 | 10/2009 | Pacey et al. | 463/20 |
| 2009/0270170 | A1 | 10/2009 | Patton | 463/36 |
| 2009/0275374 | A1 | 11/2009 | Nelson et al. | 463/16 |
| 2009/0275395 | A1 | 11/2009 | McAllister et al. | 463/25 |
| 2009/0275399 | A1 | 11/2009 | Kelly et al. | 463/27 |
| 2009/0275402 | A1 | 11/2009 | Backover et al. | 463/29 |
| 2009/0275407 | A1 | 11/2009 | Singh et al. | 463/31 |
| 2009/0275410 | A1 | 11/2009 | Kisenwether et al. | 463/42 |
| 2009/0275411 | A1 | 11/2009 | Kisenwether et al. | 463/42 |
| 2009/0305777 | A1 * | 12/2009 | Anderson | 463/27 |
| 2010/0016068 | A1 | 1/2010 | White et al. | 463/25 |
| 2010/0029385 | A1 | 2/2010 | Garvey et al. | 463/35 |
| 2010/0113125 | A1 | 5/2010 | Bernard et al. | 463/20 |
| 2010/0125851 | A1 | 5/2010 | Singh et al. | 718/104 |
| 2010/0130280 | A1 | 5/2010 | Arezina et al. | 463/20 |
| 2011/0009184 | A1 | 1/2011 | Byng | 463/20 |

FOREIGN PATENT DOCUMENTS

| | | | |
|---|---|---|---|
| EP | 1 463 008 | A2 | 9/2004 |
| GB | 2 382 034 | A | 5/2003 |
| JP | 2003-265682 | | 9/2003 |
| JP | 2004-275536 | | 10/2004 |
| WO | 96/14115 | | 5/1996 |
| WO | 97/36658 | A1 | 10/1997 |
| WO | 00/22585 | A2 | 4/2000 |
| WO | 03/023751 | | 3/2003 |
| WO | 2005/035084 | | 4/2005 |

OTHER PUBLICATIONS

Bally TMS, "MP21—Automated Table Tracking/Features," 2 pages, Nov. 2005.
Burke, A., "Tracking the Tables," reprinted from *International Gaming & Wagering Business*, Aug. 2003, 4 pages.
*Gambling Magazine*, "Gaming Company Takes RFID to the Casino," Dec. 27, 2004, accessed Aug. 25, 2006, URL=http:/www.gamblingmagazine.com/managearticle.asp?C=290&A=13186, 4 pages.
Gros, R., "All You Ever Wanted to Know About Table Games," reprinted from *Global Gaming Business*, Aug. 1, 2003, 2 pages.
MagTek, "Port Powered Swipe Reader," Technical Reference Manual, Manual Part No. 99875094 Rev 12, Jun. 2003, 20 pages.
Mikohn, "Mikohn Tablelink—The Industry's Premier Table Tracking Solution Delivers Improvements Straight to the Bottom Line," 2 pages, before Jan. 1, 2004.
Mikohn, "Tablelink™, The New Standard in Table Games," before Jan. 1, 2004, 14 pages.
Shuffle Master, Inc., "Shuffle Master Announces New Products; Intelligent Table System to Be Debuted at G2E," Sep. 10, 2003, 2 pages.
Terdiman, D., "Who's Holding the Aces Now?", reprinted from *Wired News*, Aug. 18, 2003, 2 pages.
Winkler, C., "Product Spotlight: MindPlay," reprinted from *Gaming and Leisure Technology*, Fall 2003, 2 pages.
International Search Report, mailed Nov. 27, 2009 for PCT/US2009/042160, 3 pages.
Written Opinion, mailed Nov. 27, 2009 for PCT/US2009/042160, 4 pages.
International Search Report, mailed Nov. 27, 2009, for PCT/US2009/042160, 3 pages.
Written Opinion, mailed Nov. 27, 2009, for PCT/US2009/042160, 4 pages.
International Search Report, mailed Nov. 27, 2009, for PCTAN PCT/US2009/042160, 3 pages.
Written Opinion, mailed Nov. 27, 2009, for PCTAN PCT/US2009/042160, 4 pages.

* cited by examiner

OVERLAPPING PROGRESSIVE JACKPOTS

BACKGROUND OF THE INVENTION

1. Technical Field

This description generally relates to the field of gaming devices, and more particularly to enabling participation in multiple progressive jackpots at a single gaming device.

2. Description of the Related Art

Gaming properties often devote a large percentage of floor space to gaming devices. Each gaming device presents players with individual games of chance, games of skill, or combinations thereof that a player may wager on.

Many gaming properties also offer progressive jackpots tied to one or more of the gaming devices. As used herein, the term "progressive jackpot" is a general term referring to any jackpot wherein the value of the jackpot increases as a fraction of at least some wagers accepted at participating gaming devices. Gaming properties may offer individual progressive jackpots associated solely with a single gaming device or group progressive jackpots associated with a plurality of gaming devices. Since the value of a progressive jackpot increases as a fraction of wagers made, the progressive jackpots can reach sizeable amounts that may help to increase players' excitement when playing the gaming devices.

It would be desirable to make play of these gaming devices and participation in progressive jackpots even more enjoyable for the players.

BRIEF SUMMARY

In one embodiment, a computer-implemented method of enabling participation in progressive jackpots in a gaming property comprises: accepting a wager at a gaming device; logically associating the wager with a first progressive jackpot, the first progressive jackpot associated with a first set of participating gaming devices; and logically associating the wager with a second progressive jackpot different than the first progressive jackpot, the second progressive jackpot associated with a second set of participating gaming devices, the second set of participating gaming devices comprising more gaming devices than the first set of participating gaming devices.

In another embodiment, a gaming device is disclosed, the gaming device comprising: a housing; a display carried by the housing; a user interface carried by the housing and configured to receive user input from a player; a processor that executes instructions; and a computer-readable memory that stores instructions. The instructions stored on the computer-readable memory may cause the processor to enable participation in progressive jackpots, by: accepting a wager via the user interface; logically associating the wager with a first progressive jackpot, the first progressive jackpot associated with a first set of participating gaming devices; and logically associating the wager with a second progressive jackpot different than the first progressive jackpot, the second progressive jackpot associated with a second set of participating gaming devices, the second set of participating gaming devices comprising more gaming devices than the first set of participating gaming devices.

In yet another embodiment, a computer-readable medium stores instructions that cause a processor to enable participation in progressive jackpots, by: receiving information indicative of a wager made at a gaming device; logically associating the wager with a first progressive jackpot, the first progressive jackpot associated with a first set of participating gaming devices; and logically associating the wager with a second progressive jackpot different than the first progressive jackpot, the second progressive jackpot associated with a second set of participating gaming devices, the second set of participating gaming devices comprising more gaming devices than the first set of participating gaming devices.

BRIEF DESCRIPTION OF THE SEVERAL VIEWS OF THE DRAWINGS

In the drawings, identical reference numbers identify similar elements or acts. The sizes and relative positions of elements in the drawings are not necessarily drawn to scale. For example, the shapes of various elements and angles are not drawn to scale, and some of these elements are arbitrarily enlarged and positioned to improve drawing legibility. Further, the particular shapes of the elements as drawn, are not intended to convey any information regarding the actual shape of the particular elements, and have been solely selected for ease of recognition in the drawings.

DETAILED DESCRIPTION OF EMBODIMENTS OF THE INVENTION

In the following description, certain specific details are set forth in order to provide a thorough understanding of various disclosed embodiments. However, one skilled in the relevant art will recognize that embodiments may be practiced without one or more of these specific details, or with other methods, components, materials, etc. In other instances, well-known structures and methods associated with gaming properties, gaming devices, games of chance, progressive jackpots, controllers and network communications have not been shown or described in detail to avoid unnecessarily obscuring descriptions of the embodiments.

Unless the context requires otherwise, throughout the specification and claims which follow, the word "comprise" and variations thereof, such as, "comprises" and "comprising" are to be construed in an open, inclusive sense, that is, as "including, but not limited to."

Reference throughout this specification to "one embodiment" or "an embodiment" means that a particular feature, structure or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

As used in this specification and the appended claims, the singular forms "a," "an," and "the" include plural referents unless the context clearly dictates otherwise. It should also be noted that the term "or" is generally employed in its sense including "and/or" unless the context clearly dictates otherwise.

The headings and Abstract of the Disclosure provided herein are for convenience only and do not interpret the scope or meaning of the embodiments.

Description of an Exemplary Gaming Property

Figure 1:
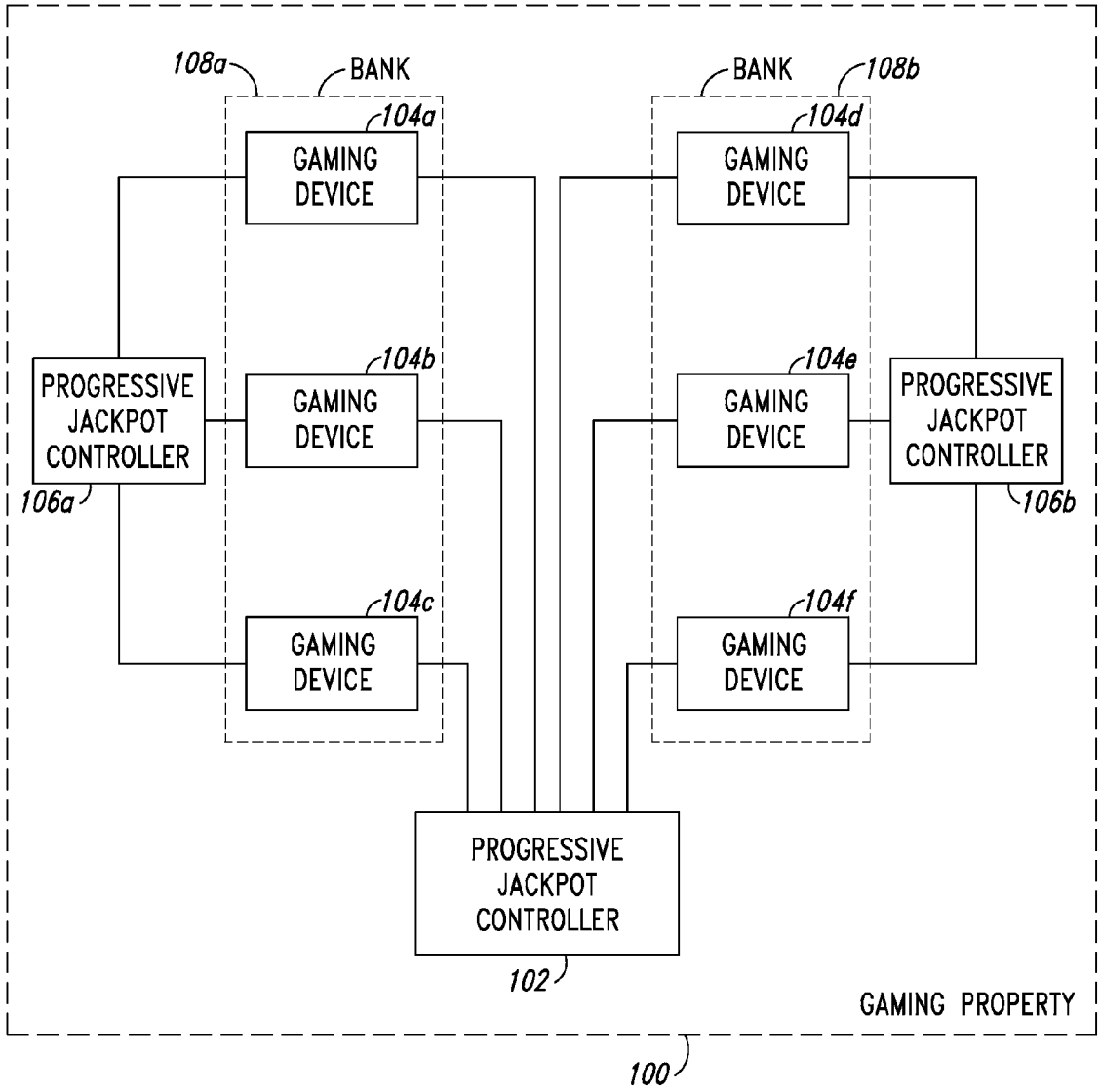
FIG. 1 is a high-level schematic view of a gaming property including a plurality of progressive jackpot controllers coupled to a plurality of gaming devices, according to one illustrated embodiment.

FIG. 1 shows a gaming property 100 including a property-wide progressive jackpot controller 102 communicatively coupled to a plurality of gaming devices 104*a-f* (collectively 104). FIG. 1 further shows that the plurality of gaming devices 104 is divided into two banks 108*a*, 108*b* (collectively 108), and two bank-wide progressive jackpot controllers 106*a*, 106*b* (collectively 106) are communicatively coupled to the gaming devices 104 of the two banks 108*a*, 108*b*, respectively. Although six gaming devices 104 are illustrated in FIG. 1, it may be understood that more or fewer gaming devices may be included in different embodiments.

The gaming property 100 may comprise any of a variety of establishments housing a plurality of gaming devices 104 used for gaming/gambling. In one embodiment, the gaming property 100 may be a casino. However, even convenience stores or gas stations having one or more gaming devices may be a gaming property 100.

In one embodiment, the banks 108 may comprise a plurality of gaming devices 104 grouped in accordance with a floor layout of the gaming property 100. For example, the gaming devices 104*a-c* may form a row of similar gaming devices in the gaming property 100. However, in other embodiments, the banks 108 may be defined as any of a number of logical groupings of the gaming devices 104 within the gaming property 100.

As illustrated, a network may be formed within the gaming property 100 between the progressive jackpot controllers 102, 106*a*, 106*b* and the gaming devices 104. This network may comprise any of a variety of networks and related hardware and/or software. In some embodiments, the network may comprise a wired or wireless enterprise-wide computer network, intranet, extranet or the Internet.

The gaming devices 104 may comprise any of a variety of electronic devices offering games of chance, games of skill, or combinations thereof that a player may wager on. Such games may include mechanical slots, video slots, video keno, video poker, video blackjack, Class II bingo, lottery, craps, a mechanical or video representation of a wheel game, etc. The gaming devices 104 may have a variety of configurations, but one example structure and configuration for the gaming devices 104 is discussed in greater detail with respect to FIGS. 2 and 3.

Of course, it may be understood that each gaming device 104 need not enable play of the same game or games as every other gaming device 104. For example, some of the gaming devices 104 may enable play of video slots, while others of the gaming devices 104 may enable play of video blackjack.

As illustrated in FIG. 1, the gaming devices 104 of the gaming property 100 are divided into a plurality of logical sets, and each of these logical sets comprises gaming devices 104 configured to participate in a corresponding progressive jackpot. Some example sets are illustrated by the dashed lines of FIG. 1. Such sets may be subsets of one another (as illustrated), or may have partial or no overlap. In one embodiment, each gaming device 104 may be considered the only member of a unitary set associated with an individual progressive jackpot. The banks 108 may also each define a bank-wide set of gaming devices 104 associated with a bank-wide progressive jackpot. Even the gaming property 100 may define a property-wide set of gaming devices 104 associated with a property-wide progressive jackpot.

Of course, other logical sets of gaming devices associated with corresponding progressive jackpots may also be defined within the gaming property 100. The sets may be organized in accordance with any of a variety of characteristics. For example, the sets may be based on physical location, types of gaming devices 104, characteristics of players playing the gaming devices 104, etc. In one embodiment, the gaming devices 104 in two or more banks 108 may define a set that comprises a subset of the total number of gaming devices in the gaming property 100.

Still other sets of participating gaming devices may be defined to include gaming devices not located within the illustrated gaming property 100. For example, gaming devices may be logically organized to form county-wide or state-wide sets of gaming devices associated with corresponding progressive jackpots. Such gaming devices may be housed in a plurality of gaming properties located throughout a respective geographical area.

Based on the above-defined sets, each gaming device 104 may participate in a plurality of progressive jackpots, wherein a single wager placed at a gaming device 104 may be logically associated with at least a first progressive jackpot and a second progressive jackpot different than the first progressive jackpot. The first progressive jackpot may be associated with a first set of participating gaming devices, and the second progressive jackpot may be associated with a second set of participating gaming devices comprising more gaming devices than the first set of participating gaming devices. As one example, the gaming device 104*a* may be a member of a unitary set, a bank-wide set identified as the bank 108*a*, and a property-wide set defined by the gaming property 100. The gaming device 104*a* may therefore enable participation in an individual progressive jackpot, a bank-wide progressive jackpot and a property-wide progressive jackpot. Indeed, a single wager placed at the gaming device 104*a* may be logically associated with all three of these jackpots.

Of course, not all of the gaming devices defining a particular set need participate in the corresponding progressive jackpot concurrently. Rather, a set is defined by the gaming devices that are configured to contribute to and participate in a corresponding progressive jackpot, regardless of the current state of those gaming devices.

In one embodiment, once a wager has been logically associated with the first and the second progressive jackpots, a first fraction of the wager may be allocated to increase the first progressive jackpot, and a second fraction of the wager may be allocated to increase the second progressive jackpot. For example, a first fraction of a wager made at the gaming device 104*a* may be allocated to increase the bank-wide progressive jackpot, and a second fraction of the wager may be allocated to increase the property-wide progressive jackpot. In some embodiments, the gaming devices 104 may allocate a fraction of only particular wagers to the progressive jackpots (e.g., only those wagers made while playing particular games, or only those wagers in which a maximum number of bets has been placed).

Since the progressive jackpots may be completely independent, different fractions may be allocated to increase the different progressive jackpots. In one embodiment, a greater fraction may be allocated to those jackpots with fewer participating gaming devices. For example, the bank-wide progressive jackpot may be allocated a greater fraction of wagers than the property-wide progressive jackpot, while the individual progressive jackpot may be allocated a still greater fraction.

It may be understood that such allocations are independent of any particular accounting method used to increase progressive jackpots by the appropriate amount. In one embodiment, the value of a progressive jackpot may simply be incremented electronically, while the monies represented by the wagers collected are placed in one or more accounts held by the gaming property 100.

In one embodiment, a player playing one of the gaming devices 104 may win at least a portion of one of the first and the second progressive jackpots when making a single wager, with independent odds of winning each progressive jackpot. In one embodiment, only one of the first and the second progressive jackpots may be won with any single wager. However, in other embodiments, two or more progressive jackpots may be won with the same wager.

The progressive jackpots may be won when a particular outcome results from a game offered at the gaming device 104. For example, certain outcomes of a video slot game may indicate a win of at least a portion of an appropriate progressive jackpot. In one embodiment, a more likely outcome may indicate a win of at least a portion of the first progressive jackpot, while a less likely outcome may indicate a win of at least a portion of the second progressive jackpot.

The odds of winning each progressive jackpot may be fixed or variable. In one embodiment, the odds of winning progressive jackpots associated with more gaming devices 104 may be worse than the odds of winning progressive jackpots associated with relatively fewer gaming devices.

Eligibility to win all or a portion of a progressive jackpot may also be based on one or more factors. In one embodiment, a player must place a wager equal to or greater than a certain minimum number of bets in order to be eligible to win one or more of the progressive jackpots. In another embodiment, a player may be eligible to win more or less of a progressive jackpot depending upon the number of bets wagered. In yet another embodiment, a player must have a player account established at the gaming property 100 in order to be eligible.

Each progressive jackpot may be monitored and administered at one of the computing devices within the gaming property 100. In some embodiments, the progressive jackpots may be monitored and administered at different progressive jackpot controllers. In other embodiments, at least some of the progressive jackpots may be monitored and administered at one universal progressive jackpot controller.

In one embodiment, the individual progressive jackpots may be monitored and administered at the gaming devices 104 themselves. For example, a progressive jackpot program executed on each of the gaming devices 104 may be configured to monitor and administer a corresponding individual progressive jackpot. The progressive jackpot program may maintain, inter alia, information indicative of which fraction of wagers should be allocated to the individual progressive jackpot, rules associated with the individual progressive jackpot, and a current value of the individual progressive jackpot. The progressive jackpot program may also maintain other information associated with the wagers made at the gaming devices 104. For example, in one embodiment, the progressive jackpot program may store information indicative of the sizes of the wagers, the times at which the wagers were placed, player identifiers associated with the wagers, etc.

The property-wide progressive jackpot controller 102 may, inter alia, monitor and administer the property-wide progressive jackpot. In some embodiments, more than one progressive jackpot may be hosted on the property-wide progressive jackpot controller 102 (including, e.g., individual or bank-wide progressive jackpots). As illustrated, the property-wide progressive jackpot controller 102 may comprise a computing device communicatively coupled to the gaming devices 104 participating in the property-wide progressive jackpot. In one embodiment, the property-wide progressive jackpot controller 102 may perform many of the same tasks described above with reference to the progressive jackpot program of each gaming device 104. The property-wide progressive jackpot controller 102 may be implemented in any of a variety of types of hardware. One example progressive jackpot controller is described in greater detail below with reference to FIG. 4.

When a wager is made at a gaming device 104 that is associated with the property-wide progressive jackpot, information indicative of that wager may be forwarded to the property-wide progressive jackpot controller 102. The forwarded information may include, inter alia, information indicative of the total wagered amount as well as eligibility information. The property-wide progressive jackpot controller 102 may receive this forwarded information and logically associate the wager with the property-wide progressive jackpot. The property-wide progressive jackpot controller 102 may then increase the property-wide progressive jackpot by at least a fraction of the wager and may assist the gaming device 104 in determining whether or not a player has won at least a portion of the property-wide progressive jackpot.

The bank-wide progressive jackpot controllers 106 may be configured to monitor and administer their respective bank-wide progressive jackpots, and may function generally similarly to the property-wide progressive jackpot controller 102. In one embodiment, the bank-wide progressive jackpot controllers 106 may also be configured similarly to the property-wide progressive jackpot controller 102.

Of course, in other embodiments, there need not be separate progressive jackpot controllers. For example, the individual and group progressive jackpots may be administered by the gaming devices 104 themselves in a distributed or peer-to-peer environment.

Description of a Suitable Gaming Device

Figure 2:
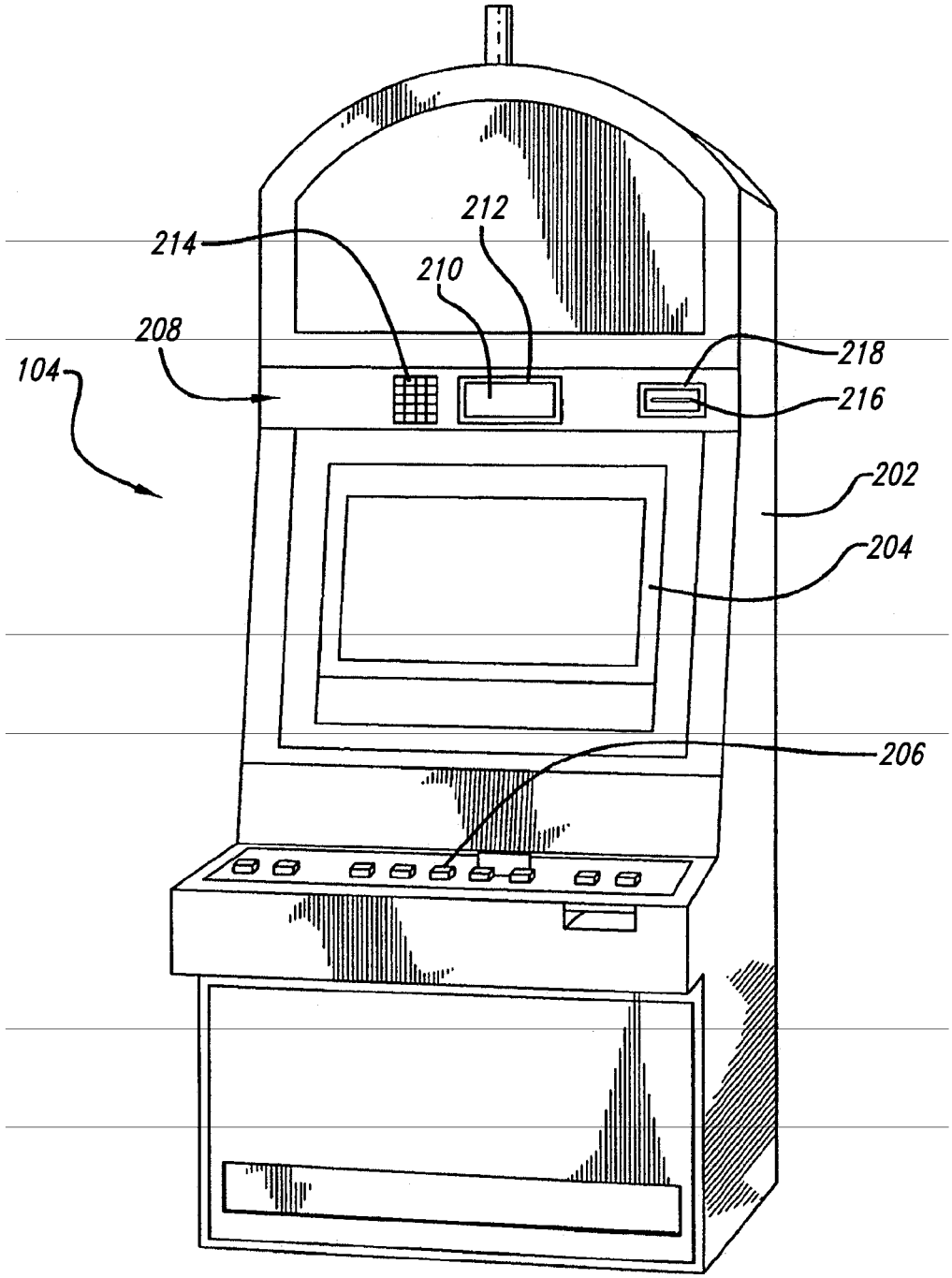
FIG. 2 is a perspective view of one of the gaming devices of FIG. 1, according to one illustrated embodiment.

Referring to FIG. 2, one example embodiment of a gaming device 104 will be described in greater detail. As illustrated, the gaming device 104 includes a housing 202, a game display 204, a plurality of player-activated buttons 206, and a player interaction system 208. The housing 202 may be a self-standing unit that is generally rectangular in shape. In other embodiments, the housing may comprise a slant-top, bar-top, or table-top style cabinet. Of course, housings of various sizes and shapes may be used in different embodiments of the gaming device 104.

The game display 204 may present one or more games of chance, such as, but not limited to, mechanical slots, video slots, video keno, video poker, mechanical or video roulette, Class II bingo, lottery, craps, blackjack, a mechanical or video representation of a wheel game, etc. One example game of chance is BLAZING 7's by Bally Technologies, Inc. In other embodiments, the game display 204 may present games of skill or games of chance involving some player skill.

The game display 204 may also present information indicative of one or more progressive jackpots associated with the gaming device 104. For example, the game display 204 may present current values for the progressive jackpots that the player may be eligible to win while playing the gaming device 104. These current values may be associated with at least one of: an individual progressive jackpot, a bank-wide progressive jackpot, a property-wide progressive jackpot, a state-wide progressive jackpot, etc.

In one embodiment, the game display 204 includes a CRT or a panel display, such as, but not limited to, liquid crystal, plasma, electroluminescent, vacuum fluorescent, field emission, or any other type of panel display. Additionally, the game display 204 may also include a touch screen or touch glass system. Thus, the game display 204 may be configured to display a variety of information to a player engaging the gaming device 104 and simultaneously act as a user interface.

The gaming device 104 may further include a variety of other user interfaces via which a player may interact with the gaming device 104. As illustrated, a plurality of player-activated buttons 106 may be provided on a shelf of the housing 202. In one embodiment, a player interaction system 208 may also be provided at the top of the housing 202. This player interaction system 208 may include a graphics display 210, a touch bezel 212, a keypad 214, a player club card reader 216, and a card reader bezel 218.

The graphics display 210 may display a variety of information to a player and may be configured similarly to the game display 204 described above. The touch bezel 212 associated with the graphics display 210 and the keypad 214 may comprise user interfaces via which a player may enter information into or otherwise interact with the gaming device 104, and more specifically with the player interaction system 208.

In one embodiment, the player club card reader 216 may be configured to read any of a variety of player club cards issued by the gaming property 100, gaming property employee cards, smart cards, and the like. Thus, the player club card reader 216 may enable the gaming property 100 to monitor and track player and employee activity each time a player or employee inserts his or her card into the player club card reader 216.

The gaming device 208 may further include a voucher printer (not shown) that prints to and then dispenses vouchers via a voucher slot 220. The voucher printer may comprise any of a variety of printers configured to encode vouchers that may be redeemed by a player. Of course, in other embodiments, other mechanisms for paying out players may be provided, including a coin hopper, a bill dispenser, a device for electronic funds transfer, etc.

Figure 3:
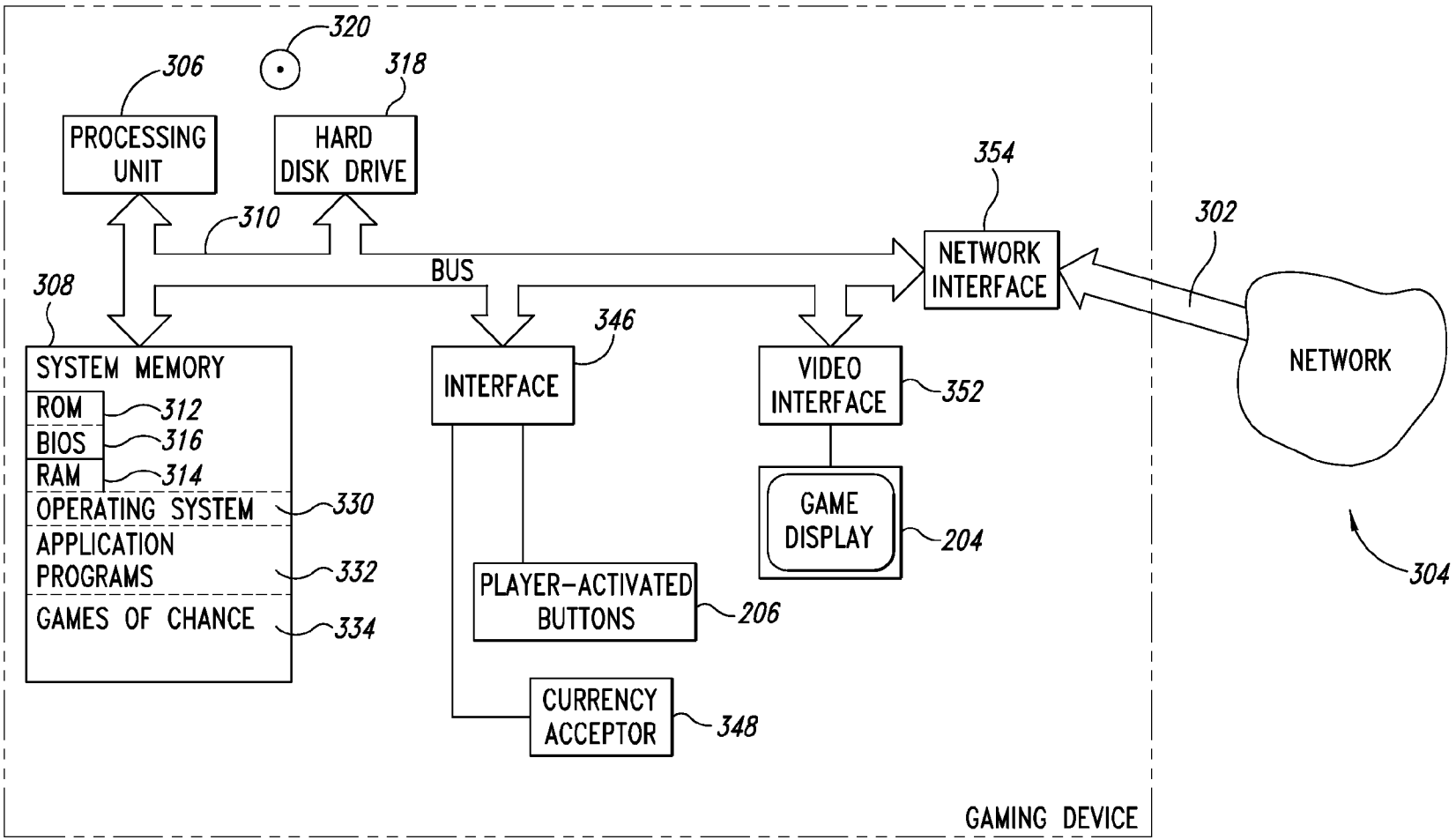
FIG. 3 is a schematic view of the gaming device of FIG. 2, according to one illustrated embodiment.

With reference to FIG. 3, the internal structure of the gaming device 104 may be described in greater detail. Although not required, the embodiments will be described in the general context of computer-executable instructions, such as program application modules, objects, or macros being executed by a computer. The embodiments can be practiced in distributed computing environments where tasks or modules are performed by remote processing devices, which are linked through a communications network. In a distributed computing environment, program modules may be located in both local and remote memory storage devices.

FIG. 3 is a schematic view of the gaming device 104. The gaming device 104 may be coupled by at least one communication channel/logical connection 302 to a network 304. This logical connection 302 may serve as any one of the logical connections illustrated in FIG. 1, communicatively coupling the gaming devices 104 to the progressive jackpot controllers 102, 106.

The gaming device 104 may have an internal configuration similar to that of a conventional PC, which includes a processing unit 306, a system memory 308 and a system bus 310 that couples various system components including the system memory 308 to the processing unit 306. The gaming device 104 will at times be referred to in the singular herein, but this is not intended to limit the embodiments to a single processor. Non-limiting examples of commercially available systems include, but are not limited to, an 80x86 or Pentium series microprocessor from Intel Corporation, U.S.A., a PowerPC microprocessor from IBM, a Sparc microprocessor from Sun Microsystems, Inc., or a PA-RISC series microprocessor from Hewlett-Packard Company.

The processing unit 306 may be any logic processing unit, such as one or more central processing units (CPUs), digital signal processors (DSPs), application-specific integrated circuits (ASICs), field programmable gate arrays (FPGAs), etc. Unless described otherwise, the construction and operation of the various blocks shown in FIG. 3 are of conventional design. As a result, such blocks need not be described in further detail herein, as they will be understood by those skilled in the relevant art.

The system bus 310 can employ any known bus structures or architectures, including a memory bus with memory controller, a peripheral bus, and a local bus. The system memory 308 includes read-only memory ("ROM") 312 and random access memory ("RAM") 314. A basic input/output system ("BIOS") 316, which can form part of the ROM 312, contains basic routines that help transfer information between elements within the gaming device 104, such as during start-up.

The gaming device 104 may also include a hard disk drive 318 for reading from and writing to a hard disk 320. The hard disk drive 318 may communicate with the processing unit 306 via the system bus 310. The hard disk drive 318 may also include an interface or controller (not shown) coupled between it and the system bus 310, as is known by those skilled in the relevant art. The hard disk drive 318 provides nonvolatile storage for computer-readable instructions, data structures, program modules and other data for the gaming device 104. Although the depicted gaming device 104 employs a hard disk 320, those skilled in the relevant art will appreciate that other types of computer-readable media that can store data accessible by a computer may be employed, such as magnetic cassettes, flash memory cards, Bernoulli cartridges, RAMs, ROMs, smart cards, optical disks, magnetic disks, etc.

Program modules can be stored in the system memory 308, such as an operating system 330, one or more application programs 332, and one or more games of chance 334. The system memory 308 may also include communications programs permitting the gaming device 104 to access and exchange data over networks. While shown in FIG. 3 as being stored in the system memory 308, the operating system 330, application programs 332, and games 334 can be stored on the hard disk 320 of the hard disk drive 318.

A player can interact with the gaming device 104 through user interfaces such as the player-activated buttons 206. Other user interfaces for receiving user input can include a touch-sensitive display, the touch-sensitive bezel 212, joystick, game pad, tablet, etc. These and other user interfaces may be connected to the processing unit 306 through an interface 346 such as a universal serial bus ("USB") interface that couples to the system bus 310, although other interfaces such as a parallel port, a game port or a wireless interface or a serial port may be used.

The interface 346 may further be coupled to a currency acceptor 348 configured to accept currency from a patron. In one embodiment, the currency acceptor 348 may include one or more coin slots, bill acceptors, etc. In another embodiment, the gaming device 104 may include a card slot for receiving a financial card issued by a financial institution (e.g., a credit/debit card), via which credits may be purchased.

The game display 204 or other display devices may be coupled to the system bus 310 via a video interface 352, such as a video adapter.

The gaming device 104 may operate in a networked environment using one or more logical connections 302 to communicate with one or more remote computers, servers and/or other gaming devices through the network 304. These logical connections may facilitate any known method of permitting computers to communicate, such as through one or more LANs and/or WANs, such as the Internet. Such networking environments are well known in wired and wireless enterprise-wide computer networks, intranets, extranets, and the Internet.

In one embodiment, the network interface 354 (communicatively linked to the system bus 310) may be used for establishing communications over the logical connection 302. In a networked environment, program modules, application programs, games, or portions thereof, can be stored outside of the gaming device 104 (not shown). Those skilled in the relevant art will recognize that the network connections shown in FIG. 3 are only some examples of ways of establishing communications between computers, and other connections may be used.

Description of a Suitable Progressive Jackpot Controller

Figure 4:
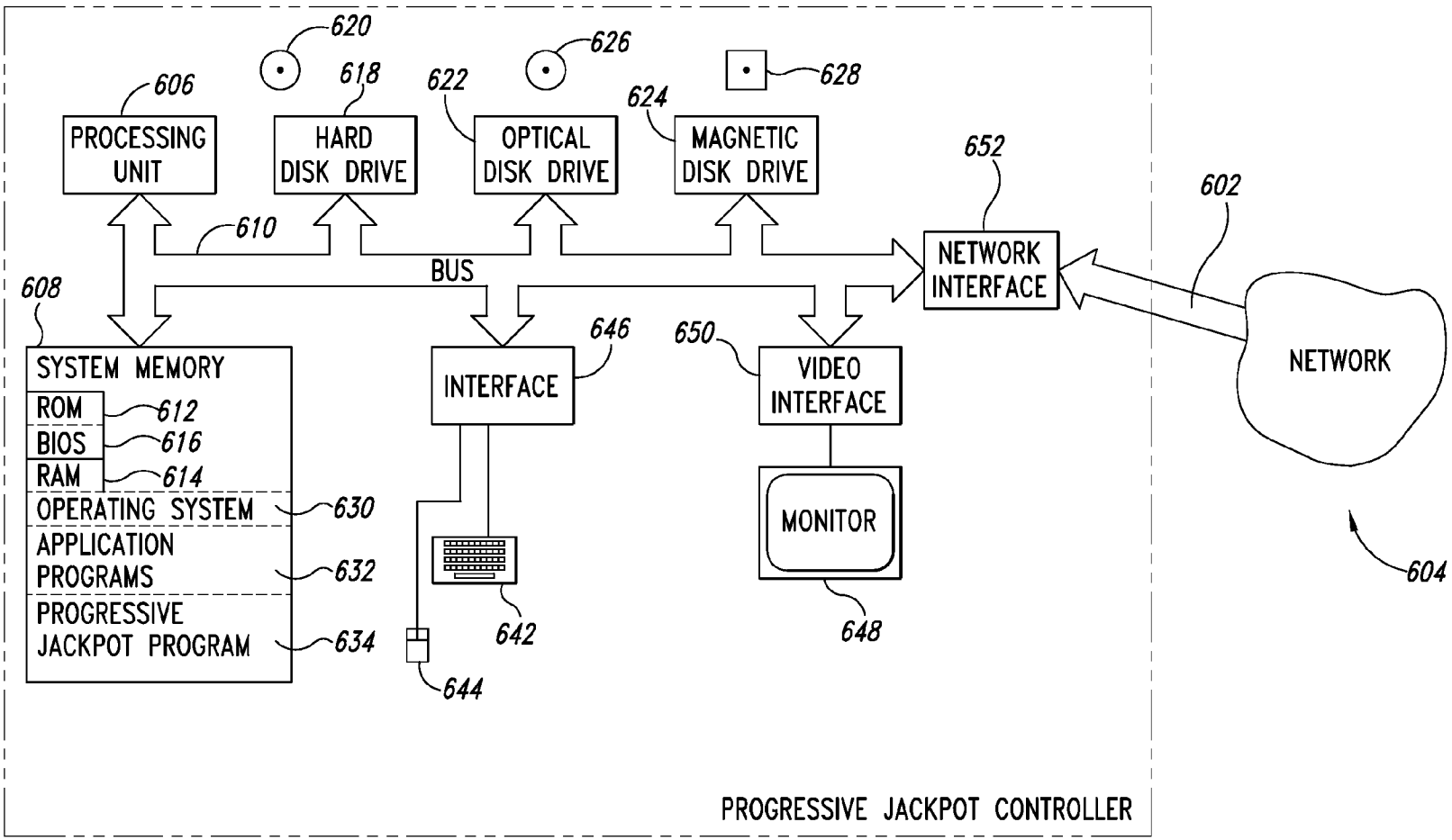
FIG. 4 is a schematic view of one of the progressive jackpot controllers of FIG. 1, according to one illustrated embodiment.

FIG. 4 and the following discussion provide a brief, general description of a suitable progressive jackpot controller 102 for use in the gaming property 100. Although not required, the embodiments will be described in the general context of computer-executable instructions, such as program application modules, objects, or macros being executed by a computer. Those skilled in the relevant art will appreciate that the illustrated embodiments as well as other embodiments can be practiced with other computer system configurations, including handheld devices, multiprocessor systems, microprocessor-based or programmable consumer electronics, personal computers ("PCs"), network PCs, minicomputers, mainframe computers, and the like. The embodiments can be practiced in distributed computing environments where tasks or modules are performed by remote processing devices, which are linked through a communications network. In a distributed computing environment, program modules may be located in both local and remote memory storage devices.

FIG. 4 shows the property-wide progressive jackpot controller 102 coupled by at least one communication channel/logical connection 402 to a network 404. This logical connection 402 may serve as any one of the logical connections illustrated in FIG. 1 communicatively coupling the progressive jackpot controller 102 to the gaming devices 104. In some embodiments, the same illustrated configuration may be used to implement the bank-wide progressive jackpot controllers 106.

The progressive jackpot controller 102 may take the form of a conventional PC, which includes a processing unit 406, a system memory 408 and a system bus 410 that couples various system components including the system memory 408 to the processing unit 406. The progressive jackpot controller 102 will at times be referred to in the singular herein, but this is not intended to limit the embodiments to a single computing device, since in certain embodiments, there will be more than one server or other networked computing device involved. Non-limiting examples of commercially available systems include, but are not limited to, an 80x86 or Pentium series microprocessor from Intel Corporation, U.S.A., a PowerPC microprocessor from IBM, a Sparc microprocessor from Sun Microsystems, Inc., or a PA-RISC series microprocessor from Hewlett-Packard Company.

The processing unit 406 may be any logic processing unit, such as one or more central processing units (CPUs), digital signal processors (DSPs), application-specific integrated circuits (ASICs), field programmable gate arrays (FPGAs), etc. Unless described otherwise, the construction and operation of the various blocks shown in FIG. 4 are of conventional design. As a result, such blocks need not be described in further detail herein, as they will be understood by those skilled in the relevant art.

The system bus 410 can employ any known bus structures or architectures, including a memory bus with memory controller, a peripheral bus, and a local bus. The system memory 408 includes read-only memory ("ROM") 412 and random access memory ("RAM") 414. A basic input/output system ("BIOS") 416, which can form part of the ROM 412, contains basic routines that help transfer information between elements within the progressive jackpot controller 102, such as during start-up.

The progressive jackpot controller 102 may also include a hard disk drive 418 for reading from and writing to a hard disk 420, and an optical disk drive 422 and a magnetic disk drive 424 for reading from and writing to removable optical disks 426 and magnetic disks 428, respectively. The optical disk 426 can be a CD or a DVD, while the magnetic disk 428 can be a magnetic floppy disk or diskette. The hard disk drive 418, optical disk drive 422 and magnetic disk drive 424 communicate with the processing unit 406 via the system bus 410. The hard disk drive 418, optical disk drive 422 and magnetic disk drive 424 may include interfaces or controllers (not shown) coupled between such drives and the system bus 410, as is known by those skilled in the relevant art. The drives 418, 422, 424, and their associated computer-readable media 420, 426, 428, provide nonvolatile storage of computer-readable instructions, data structures, program modules and other data for the progressive jackpot controller 102. Although the depicted progressive jackpot controller 102 employs hard disk 420, optical disk 426 and magnetic disk 428, those skilled in the relevant art will appreciate that other types of computer-readable media that can store data accessible by a computer may be employed, such as magnetic cassettes, flash memory cards, Bernoulli cartridges, RAMs, ROMs, smart cards, etc.

Program modules can be stored in the system memory 408, such as an operating system 430, one or more application programs 432 and a progressive jackpot program 434. The system memory 408 may also include communications programs for permitting communications over a network. The progressive jackpot program 434 may be configured to monitor and administer the property-wide progressive jackpot and may include stored settings associated with the property-wide progressive jackpot.

While shown in FIG. 4 as being stored in the system memory 408, the operating system 430, application programs 432, and progressive jackpot program 434 can be stored on the hard disk 420 of the hard disk drive 418, the optical disk 426 of the optical disk drive 422 and/or the magnetic disk 428 of the magnetic disk drive 424.

A user can enter commands and information into the progressive jackpot controller 102 through input devices such as a touch screen or keyboard 442 and/or a pointing device such as a mouse 444. Other input devices can include a microphone, joystick, game pad, tablet, scanner, etc. These and other input devices may be connected to the processing unit 406 through an interface 446 such as a universal serial bus ("USB") interface that couples to the system bus 410, although other interfaces such as a parallel port, a game port or a wireless interface or a serial port may be used. A monitor 448 or other display device may be coupled to the system bus 410 via a video interface 450, such as a video adapter.

The progressive jackpot controller 102 operates in a networked environment using one or more logical connections 402 to communicate with one or more remote gaming devices, servers and/or other computing devices through the network 404. These logical connections may facilitate any known method of permitting computers to communicate, such as through one or more LANs and/or WANs, such as the Internet. Such networking environments are well known in wired and wireless enterprise-wide computer networks, intranets, extranets, and the Internet. Other embodiments include other types of communication networks.

In one embodiment, a network interface 452 (communicatively linked to the system bus 410), may be used for establishing communications over the logical connection 402. In a networked environment, program modules, application programs, the progressive jackpot program, or portions thereof, can be stored outside of the progressive jackpot controller 102 (not shown). Those skilled in the relevant art will recognize that the network connections shown in FIG. 4 are only some examples of ways of establishing communications between computers, and other connections may be used.

Figure 5:
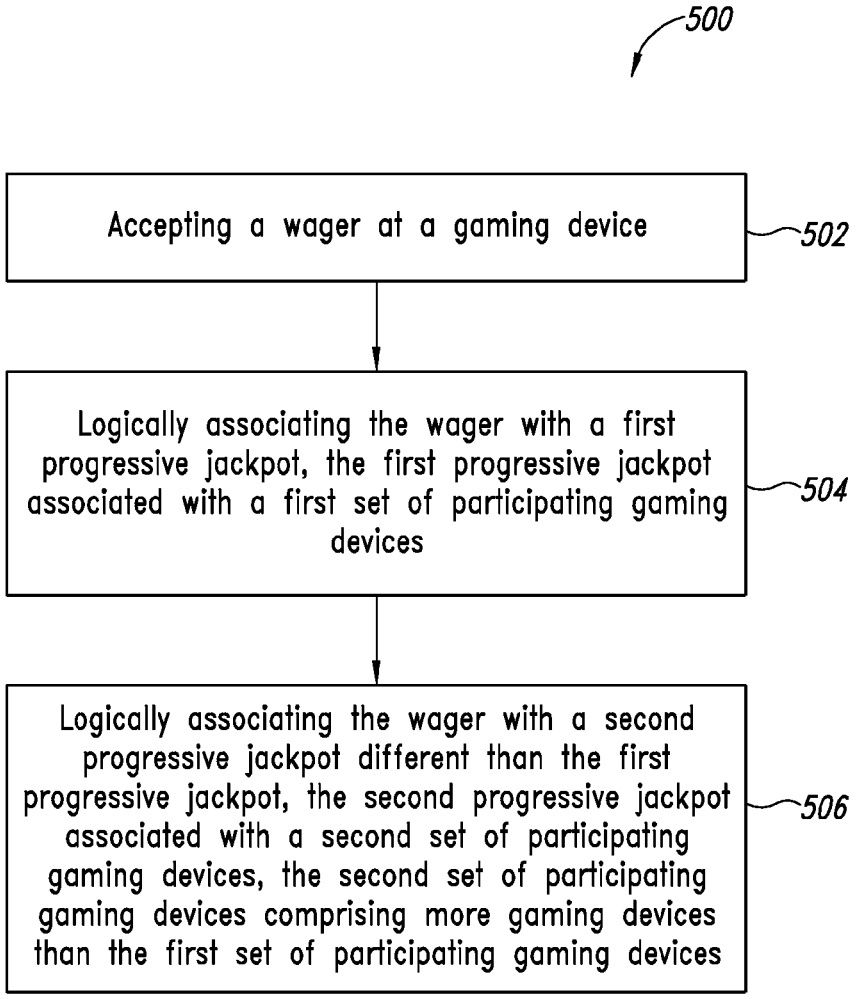
FIG. 5 is a flow diagram illustrating a method for enabling participation in progressive jackpots, according to one illustrated embodiment.

Description of an Exemplary Method for Enabling Participation in Progressive Jackpots FIG. 5 illustrates a flow diagram for a method 500 of enabling participation in progressive jackpots, according to one embodiment. This method 500 will be discussed in the context of the gaming property 100 of FIG. 1. However, it may be understood that the acts disclosed herein may be executed in a variety of different gaming properties and even between multiple gaming properties, in accordance with the described method.

The method begins at 502, when a wager is accepted at a gaming device 104. The wager may be accepted at the gaming device 104 in a variety of ways. In one embodiment, a player may first purchase a number of credits on the gaming device 104. For example, the player may use one or more currency acceptors (e.g., a coin slot, or bill acceptor) or a financial card reader. The player may then provide user input via a user interface of the gaming device 104 indicating a desire to place the wager. Provided the wager meets certain criteria (e.g., the amount of the wager is not greater than the purchased credits), the gaming device 104 may then accept the wager. The amount of the wager may then be subtracted from the purchased credits.

At 504, the wager is logically associated with a first progressive jackpot, the first progressive jackpot associated with a first set of participating gaming devices. As discussed above, the first set of participating gaming devices may comprise any number of gaming devices. In one embodiment, the first set of participating gaming devices is defined by the gaming device 104 itself. In another embodiment, the first set of participating gaming devices may be defined by a bank 108 of the gaming devices 104 in the gaming property 100. In yet another embodiment, the first set of participating gaming devices may be defined by a plurality of gaming devices 104 located throughout the gaming property 100, or by a plurality of gaming devices in a plurality of gaming properties.

The logical association may be performed at any of a number of computing devices within or outside the gaming property 100, depending upon which gaming devices are included in the first set of participating gaming devices. In one embodiment, the gaming device 104 that has accepted the wager may store information indicative of the first progressive jackpot and may perform the logical association. In another embodiment, the gaming device 104 may accept the wager and then send information indicative of the wager to a progressive jackpot controller (e.g., the property-wide progressive jackpot controller 102 or one of the bank-wide progressive jackpot controllers 106). The progressive jackpot controller may receive this information and may then logically associate the wager with the respective progressive jackpot administered thereon.

A number of actions may be taken based at least in part on the above logical association. In one embodiment, at least a first fraction of the wager may be allocated to increase the first progressive jackpot. This allocation may occur at the gaming device 104 or at a progressive jackpot controller communicatively coupled to the gaming device 104, depending upon which computing device administers the first progressive jackpot. In one embodiment, the gaming device 104 may have stored thereon a table including an increment rate indicative of which fraction of the wager should be allocated to the first progressive jackpot and may itself increase the first progressive jackpot. In another embodiment, the gaming device 104 may determine the first fraction of the wager that should be allocated to the first progressive jackpot, and information indicative of this amount may be sent to a corresponding progressive jackpot controller.

In another embodiment, the first fraction allocated to the first progressive jackpot may be variable. When the first progressive jackpot is small, for example, the first fraction may be larger to increase the value of the first progressive jackpot more quickly. However, once the first progressive jackpot has reached a certain value, the first fraction may be reduced or eliminated.

At 506, the wager is logically associated with a second progressive jackpot different than the first progressive jackpot, the second progressive jackpot associated with a second set of participating gaming devices, the second set of participating gaming devices comprising more gaming devices than the first set of participating gaming devices. As described above, the second set of participating gaming devices may comprise any number of gaming devices greater than the number of gaming devices comprising the first set of participating gaming devices. Indeed, in some embodiments, the first set of participating gaming devices may comprise a subset of the second set of participating gaming devices. In one embodiment, the first set of participating gaming devices is defined by the gaming device 104 itself, and the second set of participating gaming devices may be defined by the bank 106 of the gaming devices 104 in the gaming property 100. In another embodiment, the first set of participating gaming devices may be defined by the bank 106 of the gaming devices 104 in the gaming property 100, and the second set of participating gaming devices may be defined by a plurality of gaming devices 104 located throughout the gaming property 100, or by a plurality of gaming devices in a plurality of gaming properties.

As described above with reference to act 504, the logical association may be performed at any of a number of computing devices within or outside the gaming property 100, depending upon which gaming devices define the second set of participating gaming devices. In one embodiment, the gaming device 104 that has accepted the wager may store information indicative of the second progressive jackpot and may perform the logical association. In another embodiment, the gaming device 104 may accept the wager and then send information indicative of the wager to a progressive jackpot controller (e.g., the property-wide progressive jackpot controller 102 or one of the bank-wide progressive jackpot controllers 106). The progressive jackpot controller may then logically associate the wager with the respective progressive jackpot administered thereon.

In one embodiment, at least a second fraction of the wager may be allocated to increase the second progressive jackpot. This allocation may occur at the gaming device 104 or at a progressive jackpot controller communicatively coupled to the gaming device 104, depending upon which computing device administers the second progressive jackpot.

The second fraction may also be larger than, equal to, or smaller than the first fraction. In one embodiment, the second fraction may be smaller than the first fraction, such that the first progressive jackpot, which is associated with fewer participating gaming devices, may increase more rapidly.

In one embodiment, the method described herein may further include enabling play of a game of chance on the gaming device 104. When playing the game of chance, the odds of winning the first progressive jackpot may be better than the odds of winning the second progressive jackpot. Thus, with more gaming devices participating in the second progressive jackpot, it may be made less likely that any particular wager will win the second progressive jackpot.

The foregoing detailed description has set forth various embodiments of the devices and/or processes via the use of block diagrams, schematics, and examples. Insofar as such block diagrams, schematics, and examples contain one or more functions and/or operations, it will be understood by those skilled in the art that each function and/or operation within such block diagrams, flowcharts, or examples can be implemented, individually and/or collectively, by a wide range of hardware, software, firmware, or virtually any combination thereof. In one embodiment, the present subject matter may be implemented via Application Specific Integrated Circuits (ASICs). However, those skilled in the art will recognize that the embodiments disclosed herein, in whole or in part, can be equivalently implemented in standard integrated circuits, as one or more programs executed by one or more processors, as one or more programs executed by one or more controllers (e.g., microcontrollers), as firmware, or as virtually any combination thereof, and that designing the circuitry and/or writing the code for the software and or firmware would be well within the skill of one of ordinary skill in the art in light of this disclosure.

When logic is implemented as software and stored in memory, one skilled in the art will appreciate that logic or information can be stored on any computer readable medium for use by or in connection with any processor-related system or method. In the context of this document, a memory is a computer-readable medium that is an electronic, magnetic, optical, or other physical device or means that contains or stores a computer and/or processor program. Logic and/or the information can be embodied in any computer-readable medium for use by or in connection with an instruction execution system, apparatus, or device, such as a computer-based system, processor-containing system, or other system that can fetch the instructions from the instruction execution system, apparatus, or device and execute the instructions associated with logic and/or information.

In the context of this specification, a "computer-readable medium" can be any means that can store the program associated with logic and/or information for use by or in connection with the instruction execution system, apparatus, and/or device. The computer-readable medium can be, for example, but is not limited to, an electronic, magnetic, optical, electromagnetic, infrared, or semiconductor system, apparatus or device. More specific examples (a nonexhaustive list) of the computer readable medium would include the following: a portable computer diskette (magnetic, compact flash card, secure digital, or the like), a random access memory (RAM), a read-only memory (ROM), an erasable programmable read-only memory (EPROM, EEPROM, or Flash memory), and a portable compact disc read-only memory (CDROM). Note that the computer-readable medium could even be paper or another suitable medium upon which the program associated with logic and/or information is printed, as the program can be electronically captured, via for instance optical scanning of the paper or other medium, then compiled, interpreted or otherwise processed in a suitable manner if necessary, and then stored in memory.

The various embodiments described above can be combined to provide further embodiments. From the foregoing it will be appreciated that, although specific embodiments have been described herein for purposes of illustration, various modifications may be made without deviating from the spirit and scope of the teachings. Accordingly, the claims are not limited by the disclosed embodiments.

I claim:

1. A computer-implemented method of enabling participation in progressive jackpots in a gaming property, the method comprising:

accepting a wager at a gaming device;

logically associating the wager with a first progressive jackpot, the first progressive jackpot associated with a first set of participating gaming devices; and logically associating the wager with a second progressive jackpot different than the first progressive jackpot, the second progressive jackpot associated with a second set of participating gaming devices, the second set of participating gaming devices comprising more gaming devices than the first set of participating gaming devices, wherein logically associating the wager with the first progressive jackpot further comprises allocating at least a first fraction of the wager to increase the first progressive jackpot, the first fraction having a first value when the first progressive jackpot comprises a first amount, the first fraction having a second value when the first progressive jackpot comprises a second amount, the first value being greater than the second value when the first amount is less than the second amount, the second value being equal to zero when the second amount reaches a predetermined value level; and wherein logically associating the wager with the second progressive jackpot further comprises allocating at least a second fraction of the wager to increase the second progressive jackpot, wherein the first fraction is larger than the second fraction.

2. The method of claim 1, wherein the first set of participating gaming devices is defined by the gaming device.

3. The method of claim 1, wherein the first set of participating gaming devices is defined by a bank of gaming devices in the gaming property.

4. The method of claim 3, wherein the second set of participating gaming devices is defined by gaming devices located throughout the gaming property.

5. The method of claim 3, wherein the second set of participating gaming devices is defined by gaming devices located throughout a plurality of gaming properties.

6. The method of claim 1, wherein the wager is logically associated with the first progressive jackpot at a first progressive jackpot controller communicatively coupled to the first set of participating gaming devices.

7. The method of claim 6, wherein the wager is logically associated with the second progressive jackpot at a second progressive jackpot controller communicatively coupled to the second set of participating gaming devices, the second progressive jackpot controller different than the first progressive jackpot controller.

8. The method of claim 1, wherein the first set of participating gaming devices comprises a subset of the second set of participating gaming devices.

9. The method of claim 1, further comprising:

enabling play of a game of chance on the gaming device;

wherein odds of winning the first progressive jackpot in the game of chance are better than odds of winning the second progressive jackpot in the game of chance.

10. A gaming device comprising:

a housing;

a display carried by the housing;

a user interface carried by the housing and configured to receive user input from a player;

a processor that executes instructions; and a computer-readable memory that stores instructions that cause the processor to enable participation in progressive jackpots, by:

accepting a wager via the user interface;

logically associating the wager with a first progressive jackpot, the first progressive jackpot associated with a first set of participating gaming devices; and logically associating the wager with a second progressive jackpot different than the first progressive jackpot, the second progressive jackpot associated with a second set of participating gaming devices, the second set of participating gaming devices comprising more gaming devices than the first set of participating gaming devices, wherein logically associating the wager with the first progressive jackpot further comprises allocating at least a first fraction of the wager to increase the first progressive jackpot, the first fraction having a first value when the first progressive jackpot comprises a first amount, the first fraction having a second value when the first progressive jackpot comprises a second amount, the first value being greater than the second value when the first amount is less than the second amount, the second value being equal to zero when the second amount reaches a predetermined value level; and wherein logically associating the wager with the second progressive jackpot further comprises allocating at least a second fraction of the wager to increase the second progressive jackpot, wherein the first fraction is larger than the second fraction.

11. The gaming device of claim 10, wherein logically associating the wager with the first progressive jackpot includes sending information indicative of the wager to a first progressive jackpot controller.

12. The gaming device of claim 11, wherein logically associating the wager with the second progressive jackpot includes sending information indicative of the wager to a second progressive jackpot controller, the second progressive jackpot controller different than the first progressive jackpot controller.

13. The gaming device of claim 10, wherein the computer-readable memory stores further instructions that cause the processor to enable participation in progressive jackpots by, enabling play of a game of chance on the display, and wherein odds of winning the first progressive jackpot in the game of chance are better than odds of winning the second progressive jackpot in the game of chance.

14. A non-transitory computer-readable medium that stores instructions that cause a processor to enable participation in progressive jackpots, by:

receiving information indicative of a wager made at a gaming device;

logically associating the wager with a first progressive jackpot if the information indicative of the wager indicates that the wager is equal or greater than a predetermined number of bets associated with the first progressive jackpot, the first progressive jackpot associated with a first set of participating gaming devices defined by a bank of gaming devices in a gaming property, wherein logically associating the wager with the first progressive jackpot comprises allocating at least a first fraction of the wager to increase the first progressive jackpot, the first fraction having a first non-zero value when the first progressive jackpot comprises a first amount and having a second value that is less than the first value when the first progressive jackpot comprises a second amount that is higher than the first amount, the second value being equal to zero when the first progressive jackpot comprises a predetermined value level; and logically associating the wager with a second progressive jackpot different than the first progressive jackpot, the second progressive jackpot associated with a second set of participating gaming devices defined by gaming devices located throughout the gaming property, the second set of participating gaming devices comprising more gaming devices than the first set of participating gaming devices.

15. The non-transitory computer-readable medium of claim 14, wherein the first set of participating gaming devices is defined by the gaming device.

16. The non-transitory computer-readable medium of claim 14, wherein the second set of participating gaming devices is further defined by gaming devices in a plurality of gaming properties.

17. The non-transitory computer-readable medium of claim 14, wherein logically associating the wager with the second progressive jackpot comprises allocating at least a second fraction of the wager to increase the second progressive jackpot.

18. The non-transitory computer-readable medium of claim 14, wherein the first set of participating gaming devices comprises a subset of the second set of participating gaming devices.

* * * * *